US007204893B2

(12) United States Patent
Mino

(10) Patent No.: US 7,204,893 B2
(45) **Date of Patent: *Apr. 17, 2007**

(54) COPPER BASE ALLOY CASTING, AND METHODS FOR PRODUCING CASTING AND FORGING EMPLOYING COPPER BASE ALLOY CASTING

(75) Inventor: Kazuaki Mino, Chiba (JP)

(73) Assignee: Ishikawajima-Harima Heavy Industries, Co., Ltd., Tokyo (JP)

( * ) Notice: Subject to any disclaimer, the term of this patent is extended or adjusted under 35 U.S.C. 154(b) by 360 days.

This patent is subject to a terminal disclaimer.

(21) Appl. No.: 10/637,140

(22) Filed: Aug. 8, 2003

(65) Prior Publication Data

US 2004/0025982 A1 Feb. 12, 2004

Related U.S. Application Data

(62) Division of application No. 09/824,976, filed on Apr. 3, 2001, now Pat. No. 6,679,955.

(30) Foreign Application Priority Data

Apr. 5, 2000 (JP) ..... P2000-103662

(51) Int. Cl.
*C22C 9/06* (2006.01)

(52) U.S. Cl. ..... 148/553; 148/554; 148/680; 148/681; 148/682; 148/686

(58) Field of Classification Search ..... 148/553–554, 148/680–682, 686
See application file for complete search history.

(56) References Cited

FOREIGN PATENT DOCUMENTS

| | | | |
|---|---|---|---|
| BR | 9502356 | | 6/1996 |
| JP | 58-141352 | A | 8/1983 |
| JP | 4-198460 | | 7/1992 |
| JP | 4-231443 | A | 8/1992 |
| JP | 04221032 | * | 8/1992 |
| JP | 6-279894 | | 10/1994 |
| JP | 0941056 | | 2/1997 |
| JP | 2863627 | * | 12/1998 |

* cited by examiner

*Primary Examiner*—Sikyin Ip
(74) *Attorney, Agent, or Firm*—Pearne & Gordon LLP

(57) ABSTRACT

In the present invention, forming is carried out by employing casting to rapidly solidify molten material comprising a copper base alloy containing 3 to 20% Ag (mass % hereinafter), 0.5 to 1.5% Cr and 0.05 to 0.5% Zr. Next, an aging treatment for precipitation is carried out at 450 to 500° C., and the formed article is obtained by precipitation strengthening. In addition, in the aforementioned copper base alloy, molten material comprising a copper base alloy containing Ag in the amount of 3 to 8.5% is solidified by casting, and the solidified article or the hot worked article thereof is subjected to an aging treatment for precipitation and a thermomechanical treatment using forging or rolling, and the casting is obtained by forming the material into a specific shape and carrying out precipitation strengthening.

3 Claims, 4 Drawing Sheets

COPPER BASE ALLOY CASTING, AND METHODS FOR PRODUCING CASTING AND FORGING EMPLOYING COPPER BASE ALLOY CASTING

This is a division of U.S. application Ser. No. 09/824,976, filed Apr. 3, 2001, now U.S. patent No. 6,679,955.

BACKGROUND OF THE INVENTION

1. Field of the Invention

The present invention relates to copper base alloys, and to methods for producing a casting and a forging employing these copper base alloys.

This application is based on Japanese Patent Application No. 2000-103662, the contents of which are incorporated herein by reference.

2. Description of the Related Art

Metallic materials that are high strength and high thermal conductivity are employed in fields where materials are subjected to severe thermal fatigue, such as in the case of structural materials of forming nuclear fusion reactors and thrust chambers of a rocket engine where one surface is in contact with 3000° C. combustion gas and the other surface is in contact with liquid hydrogen.

A copper base alloy containing 0.8% Cr and 0.2% Zr (note that "%" as employed in this specification hereinafter indicates mass %) that is disclosed in Japanese unexamined Patent Application, First Publication No. Hei 04-198460 may be cited as an example of a high strength high thermal conductivity alloy that is employed in these fields. In general, a high strength, high thermal conductivity forging can be obtained from this copper base alloy by casting it, and then forming it into a specific shape by forging, rolling, etc. while applying a specific heat treatment thereto. In this copper base alloy, it is possible to increase the tensile strength while maintaining thermal conductivity at a high level, even if the alloy's composition is the same, by adjusting the conditions of the thermomechanical treatment.

In recent years, however the conditions under which structural components are employed have become severe with respect to the generation of thermal stress. At the same time, the short lifespan of conventional materials before cracking occurs has been pointed out. Thus, there has been a demand for higher resistance to thermal fatigue. To reduce thermal strain in metallic materials, it is necessary to increase thermal conductivity as well as to improve thermal fatigue strength. Improvements in thermal conductivity are near the limits, however. Thus, the challenge is to improve thermal fatigue strength without reducing thermal conductivity as compared to conventional metal materials.

It is known that in order to increase thermal fatigue strength in these types of metal materials, it is generally acceptable to increase tensile strength and tensile proof stress without reducing tensile elongation and thermal conductivity at the employed temperatures. Therefore, in order to meet the aforementioned demands, an attempt was made to increase strength by employing a copper base alloy that contained Cr (0.8%) and Zr (0.2%) as the base, and then increasing the draught of the copper base alloy by further increasing the Cr and Zr contents.

In this type of Cu—Cr—Zr alloy, a high degree of strength can be obtained if the Cr and Zr contents are increased, while at the same time generating a fiber-type microstructure by swaging or wire drawing, which apply a large deformation in one direction.

Ductility is reduced in this type of Cu—Cr—Zr alloy, however, so that thermal fatigue strength did not improve as much as expected. Moreover, there are limitations on the shape of the formed article, so that a sufficient amount of forging and rolling cannot be carried out. Thus, it was difficult to obtain the desired strength for a formed article of an optional shape. Accordingly, applications were limited to electrical parts utilizing high strength and electroconductivity.

On the other hand, a Cu—Ag alloy in which a large amount of Ag is added has been developed as a new alloy, as disclosed in Japanese Unexamined Patent Application, First Publication No. Hei 6-279894 and in SAKAI, et al: J. JAPAN INST. METALS, Vol. 55, No. 12 (1991), pp. 1382–1391. Ag, like Cr and Zr, has little solubility in Cu near room temperatures, and experiences little reduction in thermal conductivity when rendered into an alloy. However, if Ag is added in an amount of 8.5% or more, then the obtained copper base alloy forms eutectic when solidifying. Thus, if swaging or wire drawing, which apply a large deformation in one direction, are carried out in the same manner as in the case of a Cu—Cr—Zr alloy to an ingot of a Cu—Ag alloy in which 15% Ag has been added in order to obtain a sufficient amount of eutectic structure, the eutectic structure is destroyed and a fiber reinforced structure is generated. The strength obtained in this case is extremely high.

However, in the case of this type of Cu—Ag alloys, sever working such as to obtain a wire rod with a 1/10 or smaller diameter from a forged round bar is required. Thus, it is not possible to produce wrought articles of greater than a certain degree of thickness with this technology.

In addition, in the above-described metal materials, repetition of forging and heating treatments increase production costs. Accordingly, since strength on par with current levels is sufficient, there has been a desire for a metal material that is high thermal conductivity, high strength, and inexpensive that can be produced by means of casting where a forging step is not required. However, this type of metal material has not been conventionally known.

SUMMARY OF THE INVENTION

The present invention was conceived in view of the above-described problems, and has as it objective the provision of metal material that enables the inexpensive production of a high strength, high thermal conductivity metal formed article by means of simple casting, forging or rolling, in which there are no limitations on the dimensions of the formed article's shape. It is the further objective of the present invention to provide a method of production for a metal formed article employing this metal material.

The present invention provides a copper base alloy (also called "copper base alloy for casting"), that contains Ag in the range of 3 to 20%, Cr in the range of 0.5 to 1.5%, and Zr in the range of 0.05 to 0.5%, with Cu comprising the remainder.

The present invention also provides a method for producing a casting that includes a first step for melting a copper base alloy containing Ag in the range of 3 to 20%, Cr in the range of 0.5 to 1.5%, and Zr in the range of 0.05 to 0.5%, with Cu comprising the remainder; a second step for casting the molten material obtained in the first step into a specific shape by rapidly solidifying; and a third step for precipitation strengthening the formed article obtained in the second step by carrying out aging treatment at a temperature in the range of 450 to 500° C.

The phrase "rapidly solidifying" as used here means that the time required to cool the temperature of the molten material to 450 to 500° C., which is the temperature of the aging treatment for precipitation, is 10 minutes or less. Alternatively, this phrase means solidifying using a metal mold that can cool the material to 500° C. at a rate of roughly 1° C./sec once the material is solidified. Specifically, metal-mold casting methods or centrifugal casting methods are available for this purpose.

The phrase "aging treatment for precipitation" means a treatment to precipitate different phases within a matrix by holding a solid solution at a specific temperature for a specific duration of time.

A copper base alloy for casting of the aforementioned components is formed by adding Ag to a copper base alloy in which a small amount of Cr and Zr have been added. This copper base alloy makes it possible to obtain a formed article that is high strength and thermal conductivity, even in the case of casting where rolling and forging are not required.

Accordingly, if this copper base alloy for casting is employed, a casting that is high strength and thermal conductivity in which there are no limitations on the dimensions of the article's shape can be produced through the simple operation of casting.

When the amount of Ag is less than 3% in a copper base alloy of these components, then there is a marked reduction in the hardness of the casting obtained, and a high strength, high thermal conductivity casting cannot be achieved. On the other hand, there is no marked difference in effects when the amount of Ag employed exceeds 20%, and use of excessive amounts of Ag is disadvantageous from the perspective of cost.

When the amount of Cr is less than 0.5% in the copper base alloy of the above components, then there is a marked reduction in the hardness of the casting obtained, and it is not possible to achieve a high strength, high thermal conductivity casting. The maximum solubility of Cr is 0.7 to 0.8%. The eutectic reaction will occur if Cr is added in excess of this range. However, even at amounts exceeding this range, for example, in an alloy in which 1.5% Cr has been added, solidification is complete before the entire eutectic reaction has occurred provided that the cooling speed is not very slow. However, when the amount of Cr exceeds 1.5%, then an excessive amount of Cr primary crystals precipitate out during cooling at the second step. This is not desirable from the perspective of toughness and ductility.

When the amount of Zr in a copper base alloy of the above components is less than 0.05%, then the effect of reducing embrittlement at 400 to 600° C. is not sufficient. Moreover, like Cr, Zr is an effective element with respect to precipitation strengthening. The maximum solubility is 0.15%. Adding a large amount of Zr in excess of 0.5% is disadvantageous for the same reasons as cited above in the case of Cr.

In the aforementioned method for producing a casting, a supersaturated solid solution containing a forced solid solution of Ag and Cr is first formed by rapidly solidifying molten material by centrifugal casting or metal-mold casting in the second step. A structure containing a supersaturated solution of Ag in excess of its solubility can be obtained by rapidly solidifying at this stage, even when Ag is added in an amount exceeding 8.5%, which is the point of Ag—Cu eutectic formation in the phase diagram. This contributes to strengthening.

The obtained casting contains a considerable amount of Ag forced in solution. As a result, when an aging treatment for precipitation is carried out in the third step, a large amount of fine precipitates are precipitated during aging, thereby increasing the degree of strength of the casting.

The present invention also provides a copper base alloy (also referred to as a "copper base alloy for forging" to distinguish from the aforementioned "copper base alloy for casting") that includes Ag in the range of 3 to 8.5%, Cr in the range of 0.5 to 1.5% and Zr in the range of 0.05 to 0.5%, with Cu comprising the remainder.

The present invention further provides a method for producing a forging that includes a first step for melting a copper base alloy for forging; a second step for solidifying the molten material obtained in the first step by casting; and a third step for deforming the solidified article or the hot worked article thereof that was obtained in the second step into a specific shape and also precipitation strengthening, which is obtained by thermomechanical treatment using forging or rolling and aging treatment for precipitation.

The aforementioned copper base alloy for forging has the above composition. As a result, a wrought article is obtained that has superior strength and thermal conductivity, which can be formed through a simple operation and is not limited with respect to the dimensions of its shape, while at the same time employing inexpensive Cu as the base.

When the amount of Ag is less than 3% in the aforementioned copper base alloy for forging, the hardness of the obtained forging decreases markedly, and a high-strength, high-thermal conductivity forging cannot be obtained. On the other hand, there is only a slight effect obtained from adding Ag in amounts in excess of 8.5%, while this approach is disadvantageous from a cost perspective.

When the amount of Cr is less than 0.5% in the copper base alloy for forging, then the hardness of the obtained forging decreases markedly and it is not possible to obtain a high-strength, high-thermal conductivity forging. When the amount of Cr exceeds 1.5%, then a large primary crystal of Cr is generated in the second step and forgeability during hot forging falls off markedly.

When the amount of Zr is less than 0.05% in the Cu alloy for forging, there is insufficient control over embrittlement. On the other hand, when the amount of Zr exceeds 0.5%, then, as in the case of Cr, toughness and ductility decrease due to excessive precipitation.

By carrying out a thermomechanical treatment using forging or rolling to the solidified article obtained in the second step in this method for producing a forging , the crystal grains are made finer, dislocation is introduced and hardening occurs. By also employing an aging treatment for precipitation at the same time, a fine eutectic phase is uniformly generated, making it possible to further increase the strength of the forging. Thus, a high strength, high thermal conductivity forging can be obtained.

In the third step, it is preferable to carry out the thermomechanical treatment at a warm or cold of 550° C. or less. When the temperature exceeds 550° C., not only is there little work hardening, but the Ag or Cr precipitates are partially dissolved, so that larger precipitates occur, which is inconvenient. Once formed, large precipitates do not readily become finer, even if the temperature is reduced. Thus, precipitation strengthening is markedly decreased.

Next, an explanation in greater detail will be made of the requirements for achieving a high degree of strength and conductivity in the casting obtained from the present invention's Cu alloy for casting and the forging obtained from the present invention's copper base alloy for forging.

When producing a casting employing the present invention's copper base alloy, the molten material consisting of a copper base alloy containing Ag is rapidly solidified by centrifugal casting or mold casting. As a result, a supersaturated solid solution containing a forced solid solution of Ag and Cr is first generated. An aging treatment for precipitation is then carried out to this supersaturated solid solution at a temperature in the range of 450 to 500° C. As a result, very fine phases in the solid solution structure are precipitated. The amount of supersaturation in the copper base alloy becomes considerable due to rapidly solidifying. Thus, the amount of fine precipitates that are formed during aging increases, so that the strength of the casting increases.

Unlike in the usual phase diagram showing the structure in the equilibrium phase, in a rapidly solidified copper base alloy, a structure is obtained that contains a higher than anticipated solid solution of Ag. Accordingly, the amount of Ag added is effectively employed in strengthening, even when added in excess of 8.5%, which is the point of eutectic formation in the phase diagram. However, when Ag is added in excess of 20%, the solidifying speed necessary for strengthening is too large. Thus, this is not realistic, and reduces the actual efficacy.

On the other hand, in the present invention's method for producing a forging, the aforementioned copper base alloy for forging is formed to the desired shape by thermomechanical treatment using forging or rolling, and is subjected to precipitation strengthening using an aging treatment for precipitation. In this method, the amount of Ag added must be adjusted so that many Ag eutectic or Cr primary crystals are not generated. In other words, a structure in which large eutectic or primary crystal Cr appears during initial casting and solidifying because a large amount of Ag was added will cause a reduction in the efficiency of forging during hot forging. For example, in an alloys comprising just the two elements of Cu and Ag, melting begins at a eutectic temperature of 780° C. based on the typical phase diagram. This partial melting is the cause of cracking during hot working in the forging or rolling steps. Thus, it becomes necessary to place a restriction on the upper limit of the forging temperature.

Therefore, in order to prevent an excessive amount of large eutectic particles or primary Cr particles from being formed during casting and solidifying in the second step, the amount of Ag added is restricted to less than 8.5%, which is the point of eutectic formation in the phase diagram, in the present invention's copper base alloy for forging. As a result, the efficiency for forging the present invention's forging is greatly improved.

In a specific example of the present invention's method for producing a forging, strength is increased through precipitation strengthening by a thermomechanical treatment with warm working (i.e., a temperature in excess of 100° C. and less than 550° C., and preferably below 500° C.), or cold working (room temperature to 100° C.) and aging treatment. In order to increase strength by precipitation strengthening, the particle diameter of the precipitate in the structure is ideally on the order of 1/100 μm. However, by limiting the amount of Ag added to be 8.5% or less, and carrying out the thermomechanical treatment and the aging treatment for precipitation during warm or cold working, a high strength forging can be obtained in which different phase particles of the desired diameter are dispersed.

The two strengthening mechanisms of adjusting the amount of Ag and Cr added and the thermomechanical treatment are mutually promoting. In other words, the dislocation introduced in the thermomechanical treatment becomes the nucleation site for precipitating different phase particles, and contributes to precipitation of fine particles. In addition, the Ag or Cr precipitate in the dislocation limits the elimination of the dislocation by heating, thereby increasing the high temperature strength stability. The more alloy elements, the larger the effect. However, many of these elements precipitate out as primary crystals during casting/solidifying either alone or in a compound phase. Thus, employment of large amounts of these elements leads to a deterioration in forgeability in the later steps. For example, in a Cu—Cr two element alloys, when the amount of Cr added exceeds approximately 0.7%, a primary crystal precipitates out in the case of solidification maintaining the equilibrium phase. Accordingly, the suitable amount of Cr added is 0.7% or less at the equilibrium phase. However, since the speed of solidification is rapid in actuality, it is possible to increase the degree of strength by adding up to 1.5%.

By adding a suitable amount of Cr to the present invention's copper base alloy for forging, the same effects are obtained as when a large amount of Ag is added. Thus, forging efficiency can be increased and the amount of Ag added can be decreased, so that costs are reduced.

When adjusting the copper base alloy for casting or forging, Ag, Cr and Zr are added to Cu, and melted using the usual method. By adding a suitable amount of Cr, in the range of 0.5 to 1.5%, rather than adding Ag alone the effect of adding Ag is synergistically increased. Adding Cr in an amount less than 0.5% has only a small effect on improving strength.

Regarding the addition of Zr to a copper base alloy, it has been conventionally known that addition of 0.05 to 0.2% Zr has a deoxidizing effect and the effect of controlling the shape of the grain boundary precipitate. However, the addition of 0.05 to 0.5% Zr in the present invention also contributes to an improvement in tensile ductility at 400° C. and higher.

PREFERRED EMBODIMENTS OF THE PRESENT INVENTION

Specific examples of the present invention will now be explained. However, the present invention is not limited to these examples. It is of course acceptable, for example, to suitably combine structural elements of these embodiments.

(Experiment 1)

Formation of Copper Base Alloy.

Copper base alloys casting for Examples 1 to 3 and Comparative Examples 1 to 3 shown in Table 1 were formulated by melting alloy compositions that contained 0%, 2%, 4%, 8%, 16%, and 30% Ag respectively, and 0.8% Cr, 0.2% Zr and Cu as the remainder.

Copper base alloys casting for Examples 4 to 6 and Comparative Examples 4 to 6 shown in Table 2 where formulated by melting alloy compositions that contained 0%, 0.2%, 0.5%, 1%, 1.5%, and 2.5% Cr respectively, and 4% Ag, 0.2% Zr, and Cu as the remainder.

The copper base alloys casting for Comparative Examples 7 and 8 shown in Table 3 were formulated by melting alloy compositions containing 2% and 8% Ag respectively. Cr was included in the amount of 0.8%, there was no Zr, and Cu comprised the remainder.

TABLE 1

(number values are in mass %)

| Copper base alloy | Ag | Cr | Zr | Cu |
|---|---|---|---|---|
| Comp. Ex. 1 | 0 | 0.8 | 0.2 | remainder |
| Comp. Ex. 2 | 2 | 0.8 | 0.2 | remainder |
| Example 1 | 4 | 0.8 | 0.2 | remainder |
| Example 2 | 8 | 0.8 | 0.2 | remainder |
| Example 3 | 16 | 0.8 | 0.2 | remainder |
| Comp. Ex. 3 | 30 | 0.8 | 0.2 | remainder |

TABLE 2

(number values are in mass %)

| Copper base alloy | Ag | Cr | Zr | Cu |
|---|---|---|---|---|
| Comp. Ex. 4 | 4 | 0 | 0.2 | remainder |
| Comp. Ex. 5 | 4 | 0.2 | 0.2 | remainder |
| Example 4 | 4 | 0.5 | 0.2 | remainder |
| Example 5 | 4 | 1 | 0.2 | remainder |
| Example 6 | 4 | 1.5 | 0.2 | remainder |
| Comp. Ex. 6 | 4 | 2.5 | 0.2 | remainder |

TABLE 3

(number values are in mass %)

| Copper base alloy | Ag | Cr | Zr | Cu |
|---|---|---|---|---|
| Comp. Ex. 7 | 2 | 0.8 | 0 | remainder |
| Comp. Ex. 8 | 8 | 0.8 | 0 | remainder |

(Experiment 2)

Production-1 for casting (Ag effect)

The test materials for each of the copper base alloys casting in Examples 1 to 3 and Comparative Examples 1 to 3 shown in Table 1 were melted, the molten material was poured into a copper casting mold, rapidly solidified to obtain respective 50 gram ingots. Next, an aging treatment for precipitation was carried out by heating each of the ingots for 1 hour at 480° C. The ingots were then cooled to room temperature to produce castings.

Figure 1:
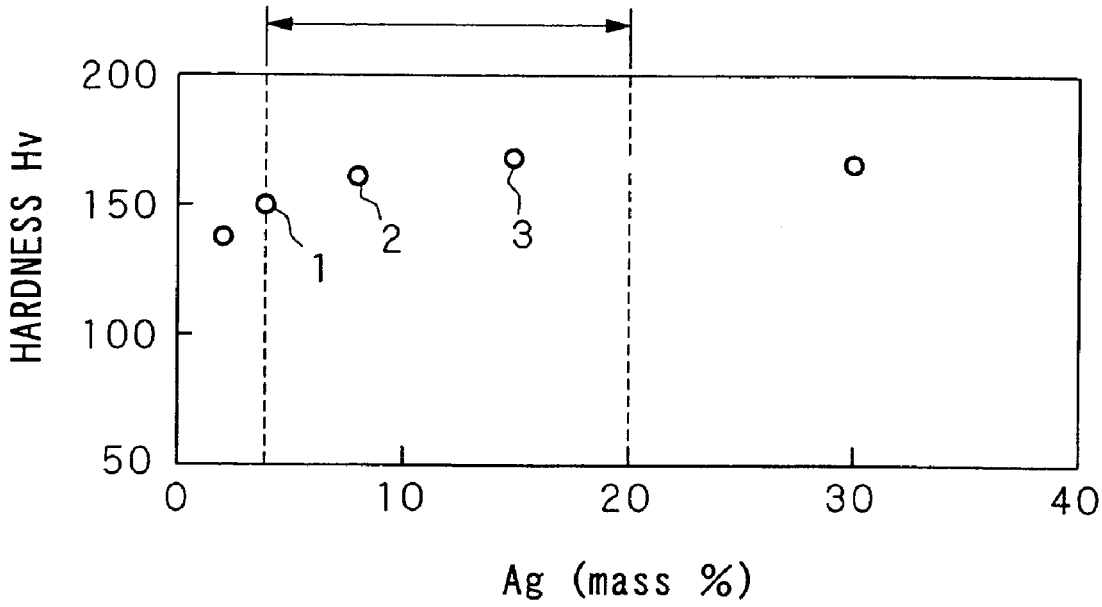
FIG. 1 is a graph showing the relationship between hardness and the amount of Ag added in the copper base alloy casting in an example of the present invention.

The Vickers hardness was measured for each of these cast articles. The results of these measurements are shown in FIG. 1. Vickers hardness is shown on the vertical axis and the amount of Ag added is shown on the horizontal axis in FIG. 1.

It may be understood from the results in FIG. 1 that the copper base alloy for casting according to Examples 1 to 3, containing Ag in the range of 3 to 20%, Cr in the amount of 0.8%, and Zr in the amount of 0.2%, with Cu comprising the remainder, provides a casting of superior hardness when following the present invention's production method for a casting. In contrast, hardness was decreased in the test materials of Comparative Examples 1 and 2, which contained no Ag or contained Ag in an amount less than 3%. The effect on hardness was saturated in the case of the test material in Comparative Example 3 which contained Ag in excess of 20%.

(Experiment 3)

Production-2 for Casting (Effect of Cr)

The test materials for each of the copper base alloys casting in Examples 4 to 6 and Comparative Examples 4 to 6 shown in Table 2 were melted, the molten material was poured into a copper casting mold, and rapidly to obtain respective 50 gram ingots. Next, an aging treatment for precipitation was carried out by heating each of the ingots for 1 hour at 480° C. The ingots were then cooled to room temperature to produce castings.

Figure 2:
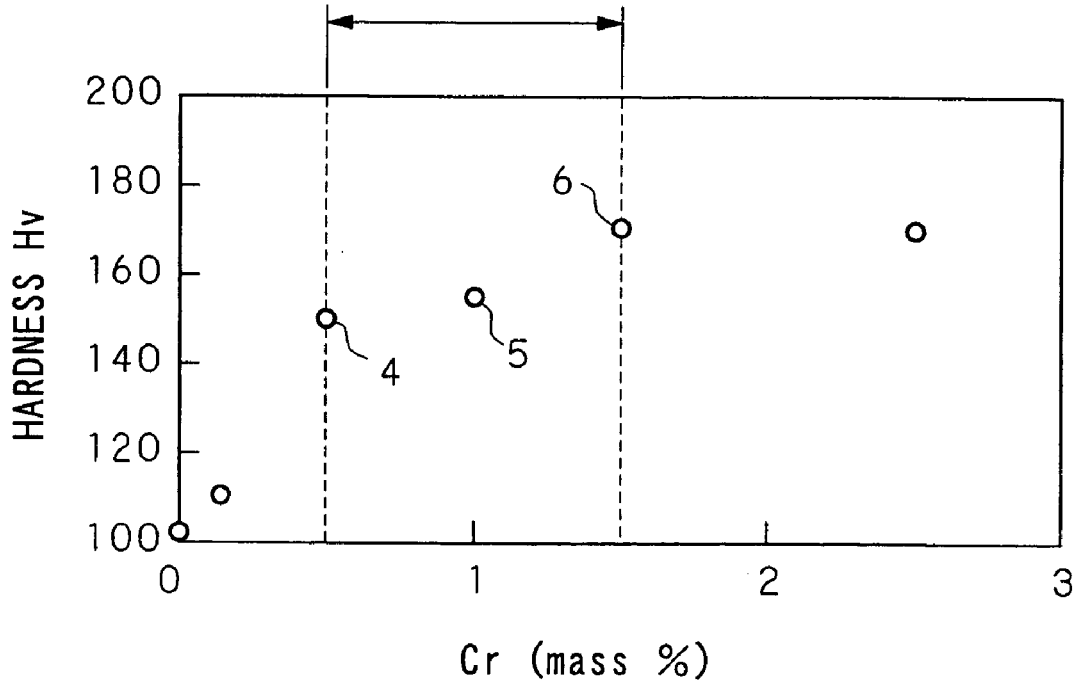
FIG. 2 is a graph showing the relationship between hardness and the amount of Cr added in the copper base alloy casting in an example of the present invention.

The Vickers hardness was measured for each of these castings. The results of these measurements are shown in FIG. 2. Vickers hardness is shown on the vertical axis and the amount of Cr added is shown on the horizontal axis in FIG. 2.

It may be understood from the results in FIG. 2 that the copper base alloy for casting according to Examples 4 to 6, containing Ag in the amount of 4%, Cr in the range of 0.5 to 1.5%, and Zr in the amount of 0.2%, with Cu comprising the remainder, provides a casting of superior hardness when following the present invention's production method for a casting. In contrast, hardness was markedly decreased in the test materials of Comparative Examples 4 and 5, which contained no Cr or contained Cr in an amount less than 0.5%. The effect on hardness was saturated in the case of the test material in Comparative Example 6 which contained Cr in excess of 1.5%.

(Experiment 4)

Production-3 for Casting (Tensile Strength)

The test materials for each of the copper base alloys casting in Examples 1 and 2 and Comparative Examples 1, 7 and 8 shown in Table 1 were melted. The molten material was quenched and solidified in a board-shaped cast iron mold 40 mm wide, 40 mm deep, and 120 mm long, to obtain respective 2 kilogram ingots. An aging treatment for precipitation was performed on each of the ingots by heating for 1 hour at 480° C. Respective castings were then obtained by cooling to room temperature.

Tensile tests were carried out on each of the castings. The tensile tests were carried out in the range of 25 to 450° C., and proof stress and increase in tensile elongation were measured.

The term "proof stress" as employed here refers to deforming stress for applying 0.2% plasticity deformation. The results of measurements of proof stress are shown in FIG. 3.

The term "increase in tensile elongation" is the tensile elongation deformation (%) during a tensile test. The results of measurements of increase in tensile elongation are shown in FIG. 4.

Figure 3:
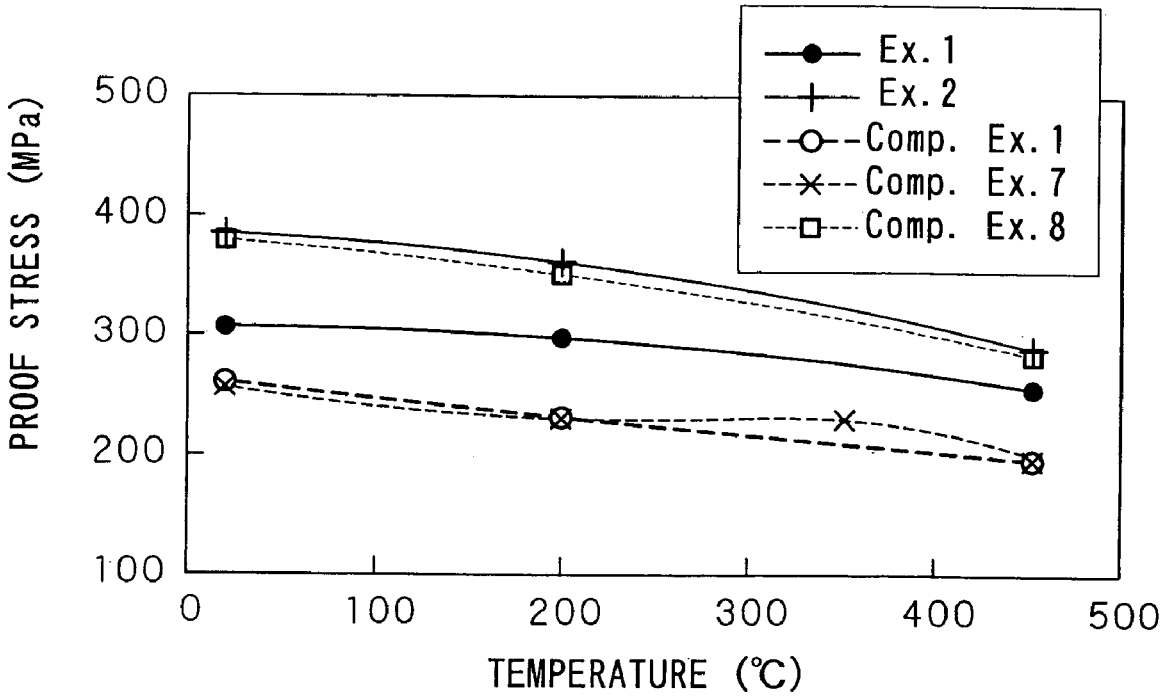
FIG. 3 is a graph showing the relationship between proof stress and the temperature of the copper base alloy casting in an example of the present invention.
Figure 4:
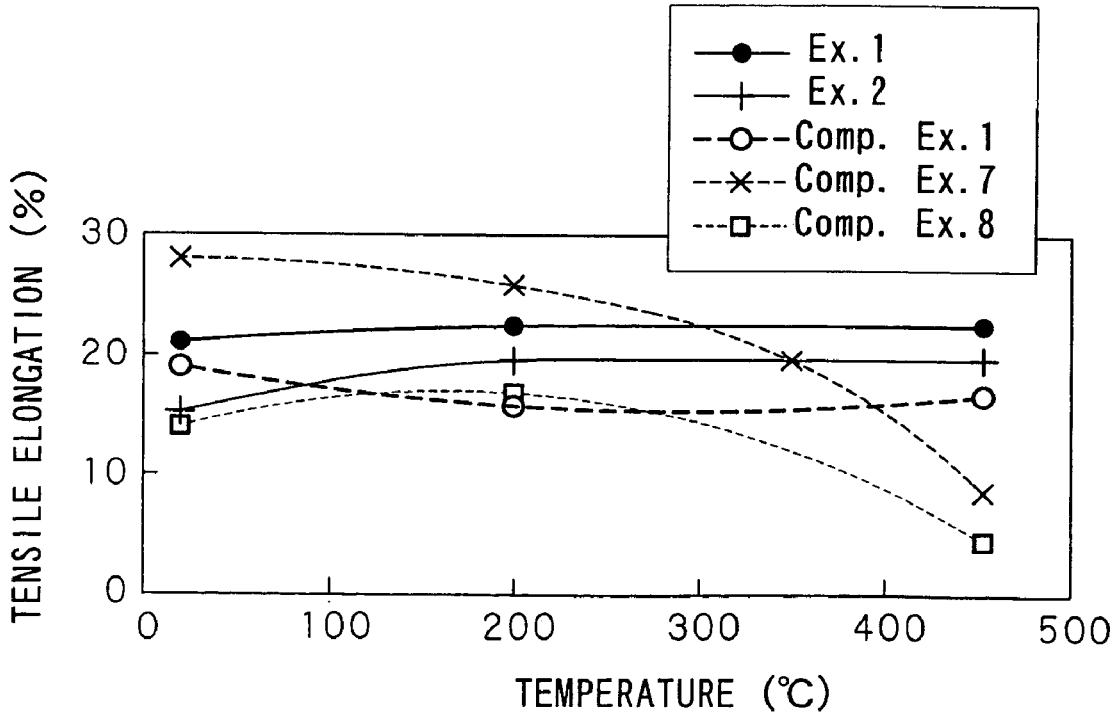
FIG. 4 is a graph showing the relationship between the increase in tensile elongation and the temperature of the copper base alloy casting in an example of the present invention.

From the results shown in FIGS. 3 and 4, the castings of the copper base alloys casting in Examples 1 and 2, which contain 4% and 8% Ag respectively, and 0.8% Cr, 0.2% Zr and the Cu as the remainder, demonstrate high values for both proof stress and increase in tensile elongation in the wide temperature range of 25 to 450° C. In particular, in the case of Example 2, in which Ag was added in the amount of 8%, a high tensile strength on par with a forging on which a expensive forging treatment is performed is obtained despite the fact that it is a casting.

In contrast, there is a decrease in tensile strength in the room to high temperature range in the case of the casting in Comparative Example 1 in which no Ag was added. The test material of Comparative Example 7, in which less than 3% Ag and no Zr was added has low proof stress throughout the measured temperature range. Increase in tensile elongation decreases rapidly in the high temperature range. The casting in Comparative Example 8 which contained 8% Ag and no Zr had a low increase in tensile elongation at 450° C. as in the case of Comparative Example 7.

The thermal conductivity of castings produced by casting the copper base alloys casting of Examples 1 and 2 was measured. Both articles demonstrated high thermal conductivity values in the range of 335 to 355 W/mK at 300° C., which is a sufficiently high thermal conductivity on par with conventional high thermal conductivity alloys.

(Experiment 5)

Production-1 for Forging (Warm Rolling)

The copper base alloy test material in Example 1 was melted, the molten material was poured into a casting mold, and solidified. The obtained ingots were rolled at 550° C. from a thickness of 40 to 20 mm, and then rolled further at 500° C. to a thickness of 10 mm. Next, precipitation strengthening was carried out by maintaining at 480° C. for one hour, followed by cooling to room temperature to produce the forging in Example 7.

For comparison, identical forging was carried out on the test material in Comparative Example 1 which did not include Ag, to produce the forging in Comparative Example 9.

Figure 5:
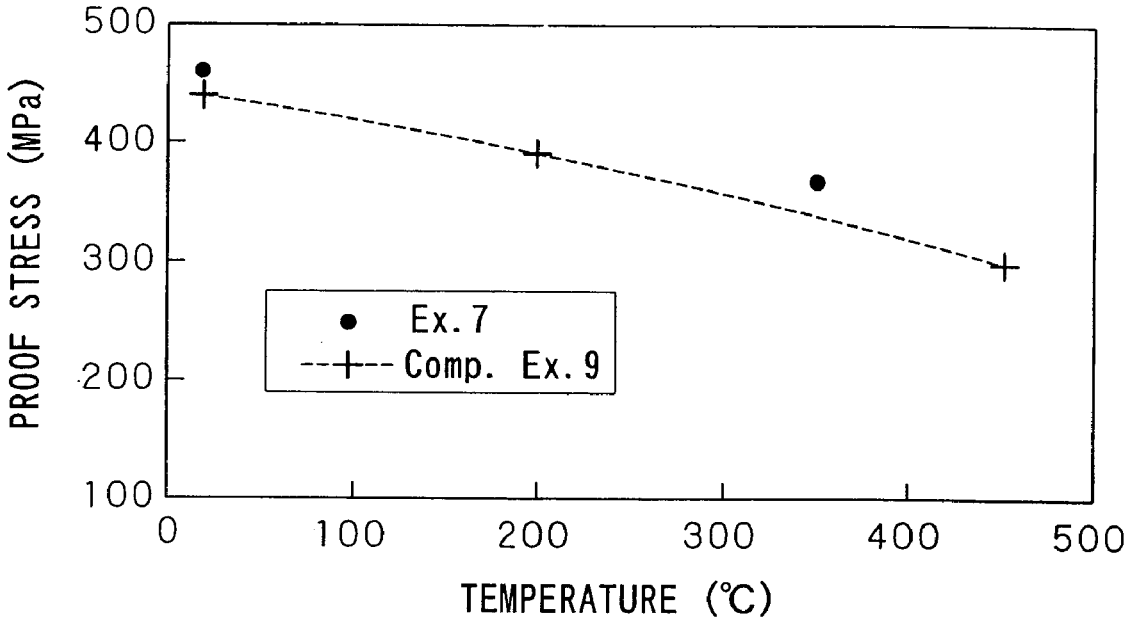
FIG. 5 is a graph showing the relationship between proof stress and the temperature of the copper base alloy forging in an example of the present invention.
Figure 6:
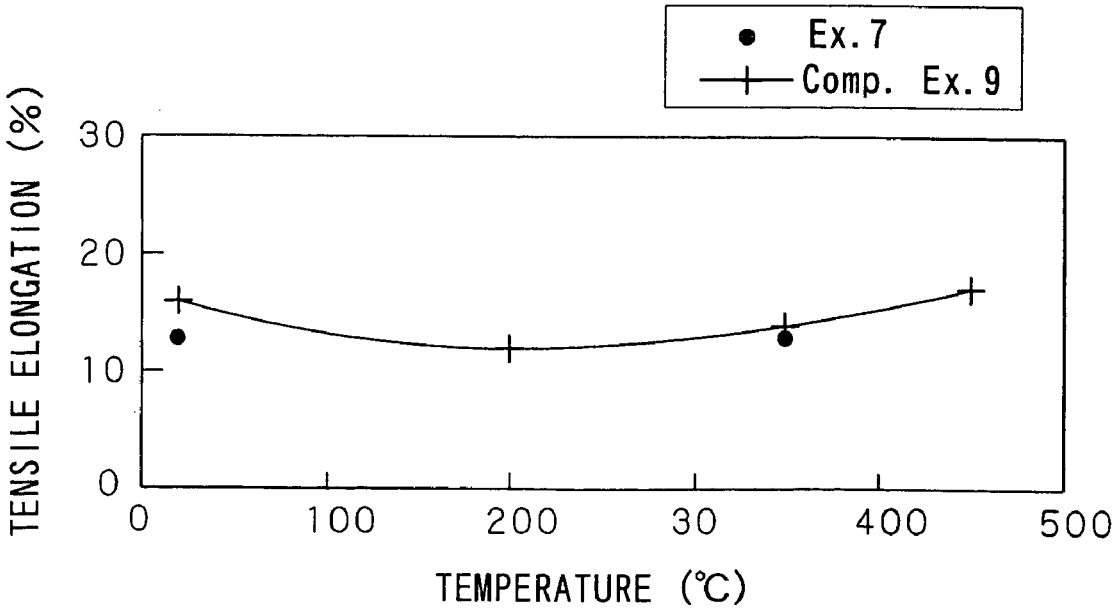
FIG. 6 is a graph showing the relationship between the increase in tensile elongation and the temperature of the copper base alloy forging in an example of the present invention.

Tensile tests were carried out on each of these forgings in the same manner as in Example 4. The tensile proof results are shown in FIG. 5 and the increase in tensile elongation results are shown in FIG. 6.

The forging in Example 7 demonstrated higher strength than the forging in Comparative Example 9 that did not include Ag over the whole range of measured temperatures. The forging of Example 7 demonstrated the same high value for thermal conductivity at 300° C. as the casting employing the copper base alloy in Example 1.

(Experiment 6)

Production-2 for Forging (Hot Rolling)

The copper base alloy test material in Example 1 was melted, the molten material was poured into a casting mold, and solidified. The obtained ingots were rolled at 750° C. from a thickness of 40 to 20 mm, and then rolled further at 500° C. to a thickness of 10 mm. Next, precipitation strengthening was carried out by maintaining at 480° C. for one hour, followed by cooling to room temperature to produce the forging in Example 8.

For comparison, identical forging was carried out on the test material in Comparative Example 1 which did not include Ag, to produce the forging in Comparative Example 10.

Figure 7:
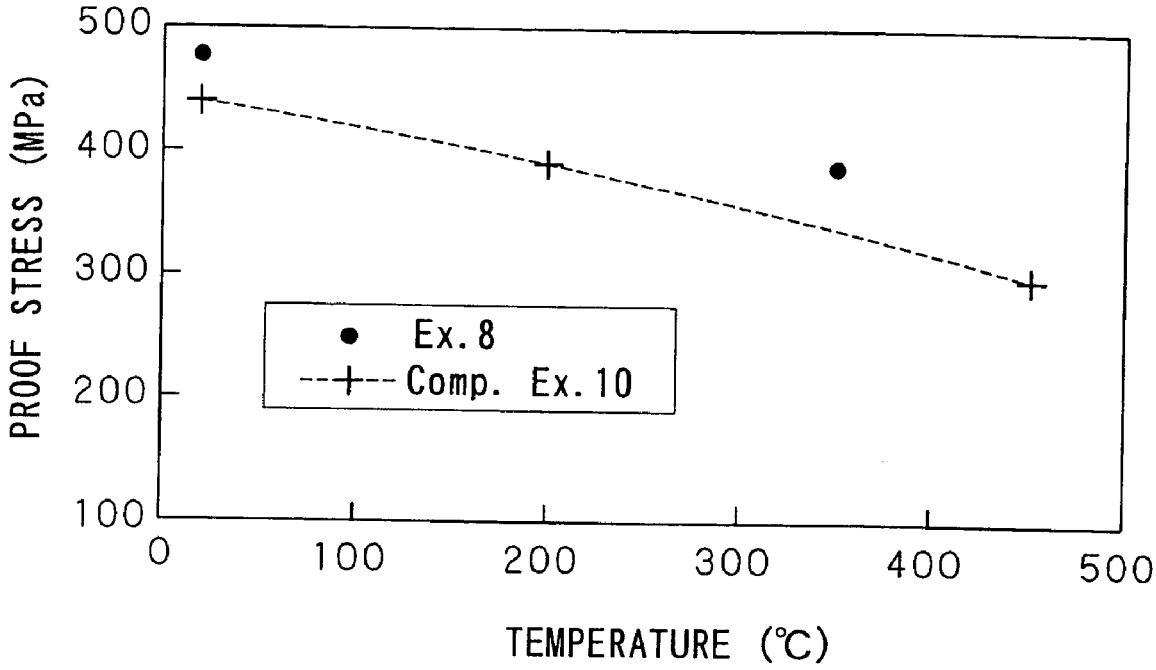
FIG. 7 is a graph showing the relationship between proof stress and the temperature of the copper base alloy forging in an example of the present invention.
Figure 8:
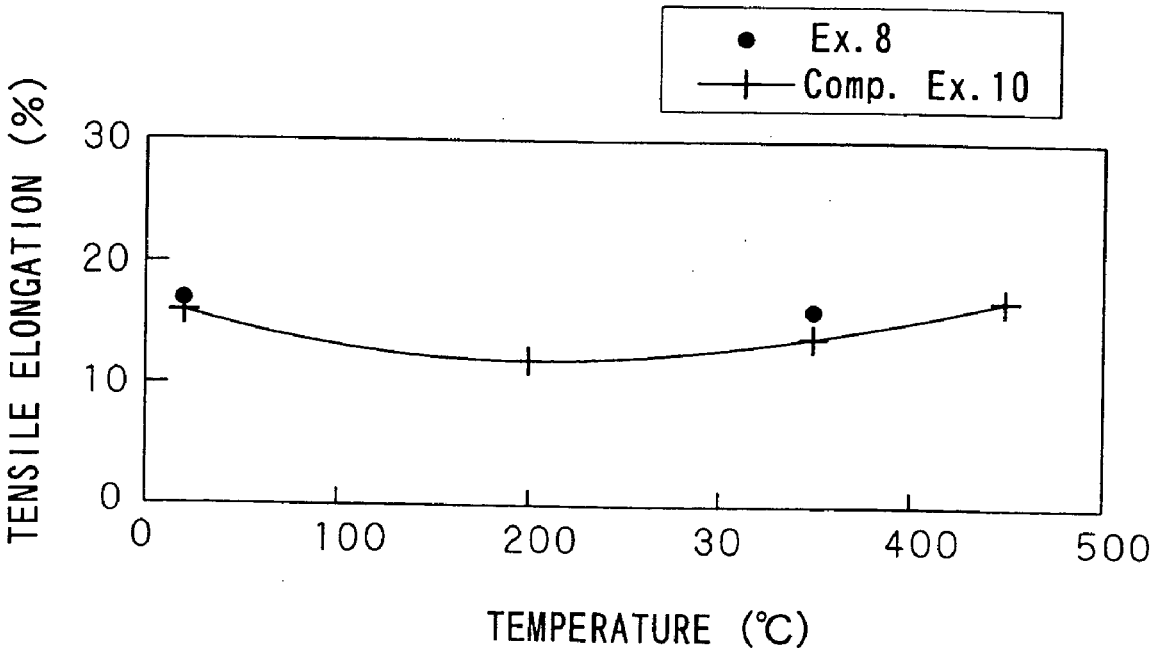
FIG. 8 is a graph showing the relationship between the increase in tensile elongation and the temperature of the copper base alloy forging in an example of the present invention.

Tensile tests were carried out on each of these forging in the same manner as in Example 4. The tensile proof results are shown in FIG. 7 and the increase in tensile elongation results are shown in FIG. 8.

The forging in Example 8 demonstrated higher proof stress than the forging in Comparative Example 10 that did not include Ag over the whole range of measured temperatures. The forging of Example 8 demonstrated the same increase in tensile elongation as the forging in Comparative Example 10.

The forging of Example 8 demonstrated the same high value for thermal conductivity at 300° C. as the casting employing the copper base alloy in Example 1.

What is claimed is:

1. A method for producing a casting, consisting the steps of:

providing a molten bath consisting essentially of 3 to 20 mass % of Ag, 0.5 to 1.5 mass % of Cr, 0.05 to 0.5 mass % of Zr and the balance being Cu and unavoidable impurities, rapidly cooling said molten bath to produce a formed article having a supersaturated solid solution containing a forced solid solution of Ag and Cr, and precipitation strengthening the formed article by aging at a temperature in the range of 450 to 500° C.

2. A method for producing a casting according to claim 1 wherein the molten bath is cooled to a temperature of 500° C. and at a rate of 1° C./sec. after solidification.

3. A method of producing a forging, consisting the steps of:

providing a molten bath consisting essentially of 3 to 8.5% by mass Ag, 0.5 to 1.5% by mass Cr, 0.05 to 0.5% by mass Zr and the balance being Cu and unavoidable impurities, casting said molten bath to product a solidified article, forming the solidified article into a predetermined shape, and precipitation strengthening the article by aging for precipitation and forging or rolling at a temperature in excess of 100° C. and less than 550° C.

* * * * *